US006935783B2

(12) United States Patent
Carter

(10) Patent No.: US 6,935,783 B2
(45) Date of Patent: Aug. 30, 2005

(54) SINGLE-USE CONTAINER

(76) Inventor: Travis S. Carter, 320 W. 10th Ave., #104, Kennewick, WA (US) 99336

( * ) Notice: Subject to any disclaimer, the term of this patent is extended or adjusted under 35 U.S.C. 154(b) by 39 days.

(21) Appl. No.: 10/600,498

(22) Filed: Jun. 19, 2003

(65) Prior Publication Data

US 2004/0264816 A1 Dec. 30, 2004

(51) Int. Cl.[7] ..... B65D 33/00

(52) U.S. Cl. ..... 383/207; 383/38; 383/40; 383/63; 383/98; 383/906

(58) Field of Search ..... 383/207–209, 383/906, 63, 84, 93, 38–40, 98

(56) References Cited

U.S. PATENT DOCUMENTS

| | | | | |
|---|---|---|---|---|
| 2,371,521 A | | 3/1945 | Heywood et al. | |
| 2,390,822 A | | 12/1945 | Wren | |
| 2,442,646 A | | 6/1948 | Fields | |
| 3,159,096 A | | 12/1964 | Tocker | |
| 3,469,768 A | * | 9/1969 | Repko | 383/207 |
| 4,557,377 A | * | 12/1985 | Maloney | 206/219 |
| 4,744,674 A | * | 5/1988 | Nocek | 383/63 |
| 4,785,940 A | | 11/1988 | Wilson | |
| 4,818,544 A | | 4/1989 | Seward | |
| 5,709,479 A | * | 1/1998 | Bell | 383/209 |
| 5,971,613 A | | 10/1999 | Bell | |
| 6,149,302 A | * | 11/2000 | Taheri | 383/5 |

* cited by examiner

*Primary Examiner*—Jes F. Pascua
(74) *Attorney, Agent, or Firm*—Seed IP Law Group PLLC

(57) ABSTRACT

A single-use container having front and back panels positioned in face-to-face relationship and joined with a sealed region around three edges to define a pouch, with a fourth edge unsealed to form a first opening in the pouch. A pressure sensitive strip on the front and back sides adjacent the opening of the pouch to seal the opening when the front and back sides are pressed closed. A tear line is formed at an opposing end of the pouch to enable opening of the opposing end of the pouch. The container may include a tool pouch defined on four sides by the sealed region and containing a spreading tool. The tool pouch is intersected by the tear line, such that, when the container is torn along the line, the tool is released from the tool pouch.

15 Claims, 5 Drawing Sheets

SINGLE-USE CONTAINER

BACKGROUND OF THE INVENTION

1. Field of the Invention

The present invention relates generally to the field of storage containers for consumables, and in particular to one-time-use containers configured to hold sufficient product for a single use.

2. Description of the Related Art

Consumers are familiar with single-use containers, such as the packets that hold individual servings of ketchup and mustard found at many fast food restaurants. The packet is opened by tearing across one end to create an opening, and the contents are then squeezed out as necessary. The empty packet is then discarded. These packets are manufactured in a variety of sizes and are used to dispense a variety of products, including, for example, in addition to common condiments, honey, frozen confections, powdered mixes for beverages such as hot cocoa and apple cider, and many other food products. Additionally, manufacturers provide single-use quantities of shampoos, creams, and other toiletries, as promotional samples. Industrial applications of single-use packaging includes adhesives, lubricants, and hand cleaners.

While such packaging is often very convenient, the portion sizes and contents are selected by the manufacturer. This type of single-use packaging is not suitable for use by consumers because it requires specialized machinery to fill and close such packages. Accordingly, there is a need for disposable, one-time use packaging that allows an individual to select not only the contents but the quantity on a personalized basis.

BRIEF SUMMARY OF THE INVENTION

According to an embodiment of the invention, a fillable, disposable single-use container is provided. The container includes front and back panels positioned in face-to-face relationship, the panels formulated to resist fluids. A sealed region joins the front and back panels together around a perimeter to define a pouch between the front and back panels, with a portion of the perimeter unsealed to form a first opening of the pouch. A pressure sensitive strip is located on the sides adjacent the first opening of the pouch and configured to seal the first opening when the sides of the container are pressed closed by the user. A tear line defines a line along which the container is configured to be opened, the tear line positioned such that tearing along the line will create a second opening in the container. The container may include a spout defined by a portion of the sealed region where the region narrows along a short length of the perimeter. The spout is positioned, relative to the tear line, so that when the container is torn along the tear line, the spout is opened.

According to another embodiment of the invention, the single-use container further includes a flap coupled to the back panel and extending beyond an edge of the front panel, the flap configured to fold over the front panel, closing the first opening. The pressure sensitive strip is positioned on the flap and includes a release liner positioned over the pressure sensitive strip, such that, when the release liner is removed, the pressure sensitive strip is exposed.

According to another embodiment of the invention, the single-use container further comprises a tool pouch defined on four sides by the sealed region and containing a spreading tool. The tool pouch is intersected by the tear line, such that, when the container is torn along the line, the tool is released from the tool pouch.

According to another embodiment of the invention, a method of operation is provided, including the steps of placing a quantity of a product, ideally sufficient for one use, within a container via an opening therein, sealing the opening, tearing the container to open a spout therein, and dispensing the product through the spout. Ideally, the step of tearing includes releasing a tool sealed in a tool pouch adjacent the formed spout. Alternatively, the tool pouch forms the spout when the container is torn open.

DETAILED DESCRIPTION OF THE INVENTION

Figure 2:
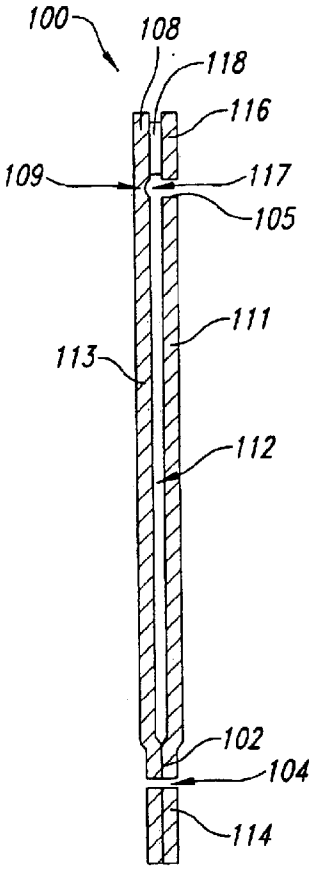
FIG. 2 shows the container of FIG. 1 in cross-section, taken along the lines 2—2.
Figure 1:
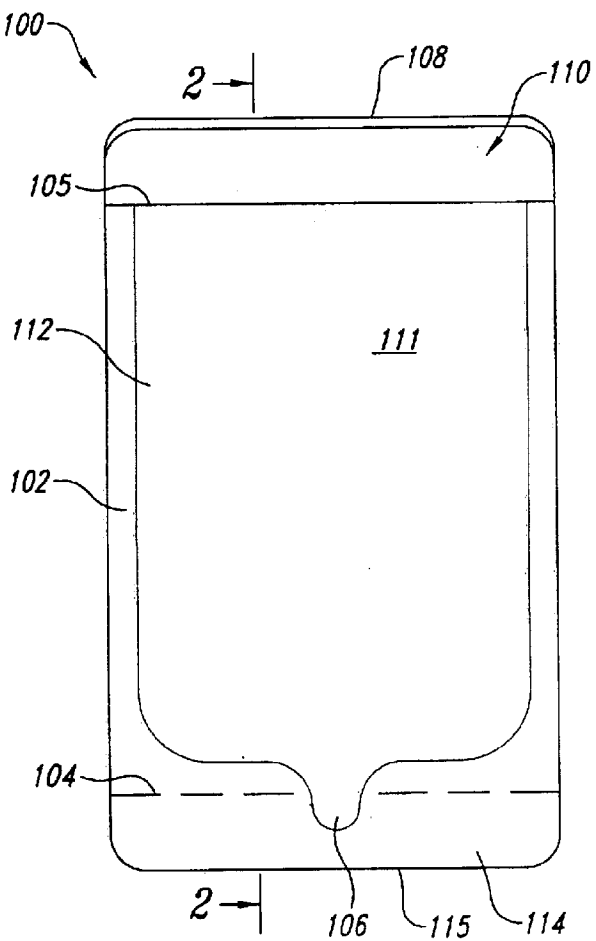
FIG. 1 shows a plan view of a single-use container according to one embodiment of the invention.

A single use container 100 is illustrated in FIGS. 1–4, according to a first embodiment of the invention. FIG. 1 shows the single use container 100 in plan view while FIG. 2 shows the container 100 in cross-section, taken along lines 2—2 of FIG. 1. It will be understood that the figures are not drawn to any particular scale and are intended merely as examples. FIG. 2, especially, is exaggerated to better illustrate the various features of the container 100. As shown in FIGS. 1 and 2, the single use container 100 includes a front panel 111 and a back panel 113. The front and back panels 111, 113 are joined together in a sealed region 102, extending on three sides of the container 100, which defines a storage pouch 112 having an opening 117. The front and back panels 111, 113 are joined using a known method, such as heat welding, RF welding, solvent welding, or the use of adhesives, for example.

The front and back panels 111, 113 may be formed from any of a wide variety of materials, including a number of different types of plastics, Mylar, metallized or plasticized paper, and equivalent materials as known to those skilled in the art. Criteria for the selection of the material and dimensions of the container 100 include availability, cost of manufacture, disposability, flexibility, and intended use. For example, the material may be selected to be impermeable to fluids such as water based products, oil based products, etc. The material may also be selected to be impermeable to gaseous fluids, to maintain freshness of the contents.

Figure 3:
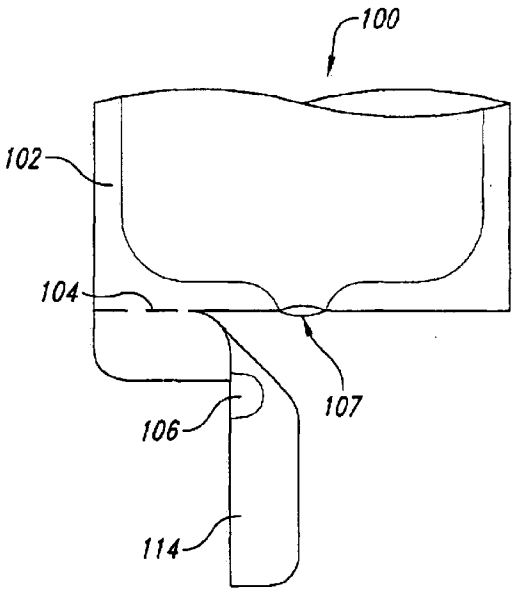
FIG. 3 shows a detail of the container of FIG. 1, illustrating particular features thereof.

A narrowing of the sealed region 102 of the container 100 defines a narrow excursion 106 of the pouch that extends close to an edge 115 of the container 100. A tear line 104 extends across a width of the container 100 close to the edge 115 and bracketing the excursion 106, such that, when the container is torn along the tear line 104, the storage pouch 112 is opened at the excursion 106 and forms a spout 107, as illustrated in FIG. 3. The tear line 104 is shown in the figures as a row of perforations. However, it will be understood that the tear line in this and other embodiments of the invention may comprise a scored line in the material of the container, or a notch in an edge of the container positioned such that the material of the container will tear at the notch when subjected to sufficient shear force by the user. Other means for facilitating easy tearing at the selected location of the container are considered equivalent.

Alternatively, the container 100 may be formed without an excursion 106, in which case the tear line 104 is positioned to be torn along the line 104 so that a bottom region of the container, such as a corner, is opened to form a spout.

The back panel 113 includes a closure flap 108, which extends beyond an edge 105 of the front panel 111. A strip of pressure sensitive adhesive 118 extends across the closure flap 108, such that, when the closure flap 108 is folded over the edge 105 of the front panel 111, the pressure sensitive adhesive strip 118 joins the closure flap 118 to the outer surface of the front panel 111, thereby sealing the pouch 112. A release liner strip 116 is positioned over the pressure sensitive adhesive strip 118 to protect the adhesive strip 118 until such time as the closure flap 108 is folded over. The back panel 113 may include a scored line 109 corresponding to an optimal folding point of the flap 108.

Figure 4A:
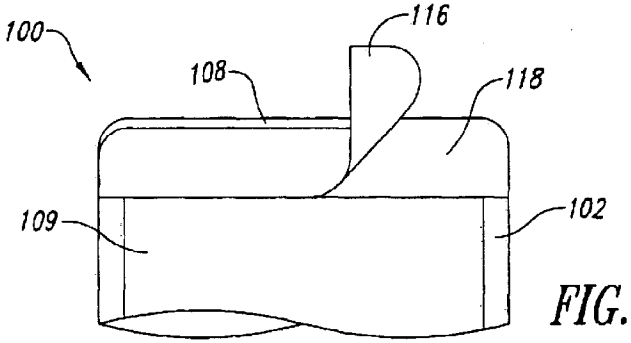
FIGS. 4A–4C show sequential steps for closing and sealing the container of the embodiment of FIG. 1.
Figure 4B:
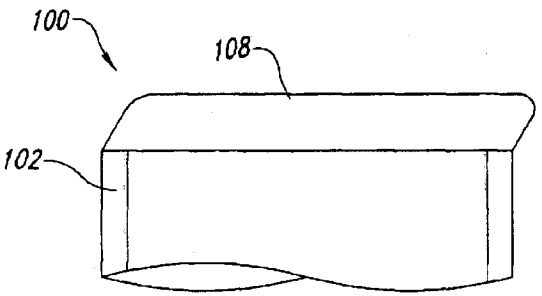
Figure 4C:
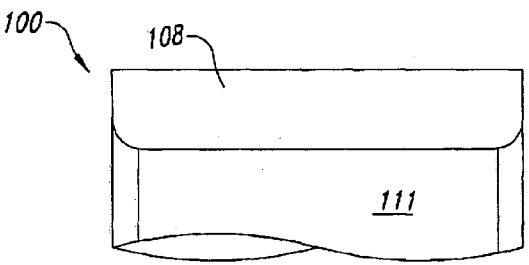

FIGS. 4A–4C illustrate the procedure for closing the container 100 after it is filled with product. FIG. 4 shows the release liner 116 partially peeled away from the adhesive strip 118. FIG. 4B shows the closure flap 108 partially folded over and in FIG. 4C the closure flap 108 is completely folded over in the sealed position on the front panel 111.

The single use container 100 may be formed in a wide variety of sizes and shapes, according to its intended use. The container 100 may include gussets, tucks, or pleats, for the purpose of modifying the shape or capacity of the pouch 112. Such modifications are well known in the art and will not be discussed in detail here.

The single use container 100 is suitable for storage and dispensing of small quantities of selected of products. For example, the container 100 may be used to hold a small quantity of mayonnaise or some other condiment to be packed in a lunch with a sandwich. The user would first place the condiment within the pouch 112 via the open end of the pouch 117. The release liner 116 is then peeled away from the adhesive strip 118, whereupon the closure flap 108 is folded over at the score line 109 and pressed firmly against the front panel 111, with the adhesive strip 118 therebetween, sealing the pouch 112. When the user is ready to dispense the condiment, the tear tab 114 is separated from the rest of the container 100 at the tear line 104, opening the spout 107. The user then applies downward pressure on the pouch 112 until the condiment is forced through the spout 107 as directed by the user.

It will be recognized that the single use container 100 may be used in a variety of applications, in addition to storing and dispensing condiments. For example, the container 100 may be used for storing small amounts of shampoo or other toiletries for use in travel kits, obviating the need to carry bottles or large tubes of such toiletries. Liquid adhesives, lubricants, and other industrial substances may be stored in single use quantities in the container. Other possible uses for the container will be obvious to those of ordinary skill in the art and are considered to fall within the scope of the invention.

Figure 5:
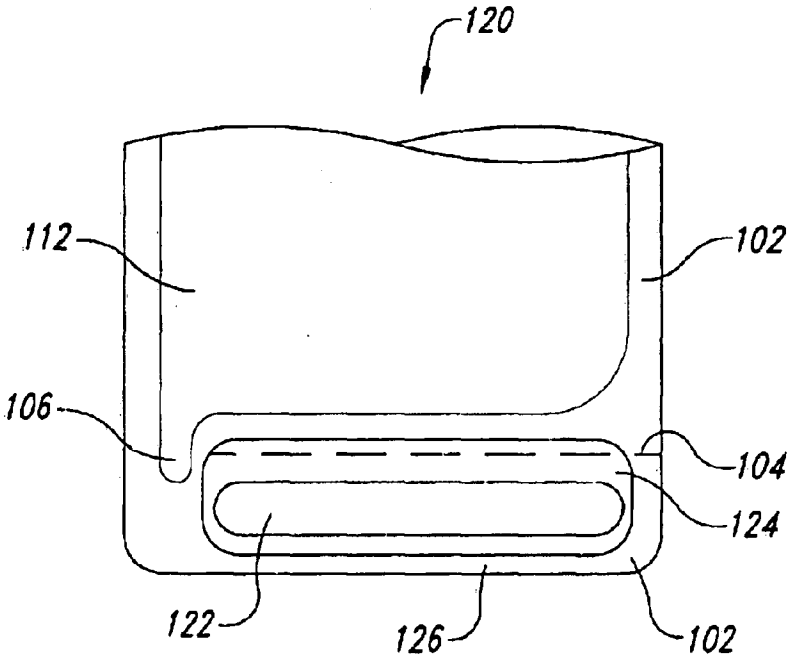
FIG. 5 shows a detail of an alternate embodiment of the invention.

FIG. 5 illustrates a second embodiment of the invention in which a second pouch 124 is defined by the sealed region 102. A tool 122 is trapped within the second pouch 124 during the manufacturing process of the container 120. The tool 122 may be formed, for example, from rigid plastic or thin wood and is configured to facilitate the dispensing and spreading of the contents of the container 120. The tear line 104 intersects the second pouch 124 such that, when the tear tab 126 is separated from the rest of the container 120 along the tear line 104, the tool 122 is released from the second pouch 124 at the same time that the excursion 106 of the pouch 112 is opened to form the spout 107. The tool 122 is then used to disburse the contents of the pouch 112. Alternatively, the tool pouch is formed in the area of the sealed region that becomes the spout.

Figure 6:
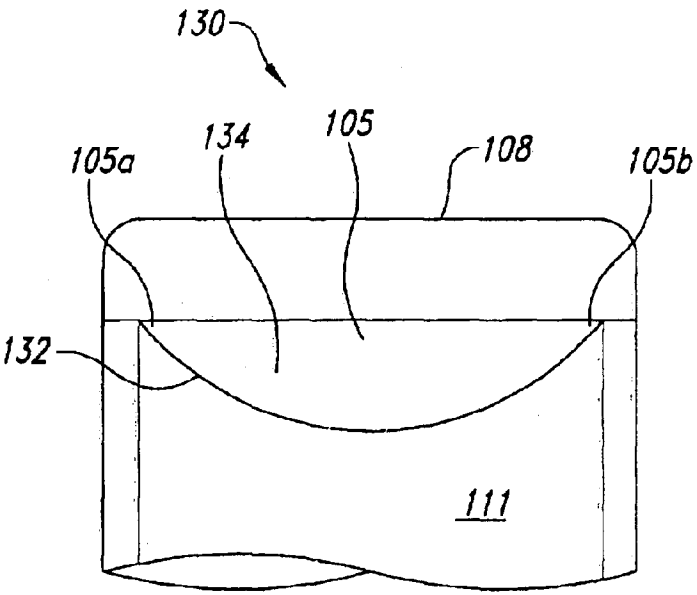
FIG. 6 shows a detail of a third embodiment of the invention.
Figure 8:
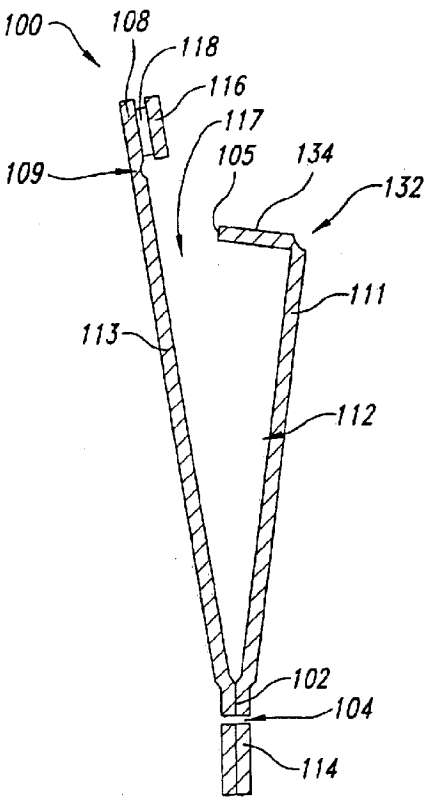
FIG. 8 shows a cross-section of the container according to the embodiment of FIG. 7 taken along the lines 8—8.
Figure 7:
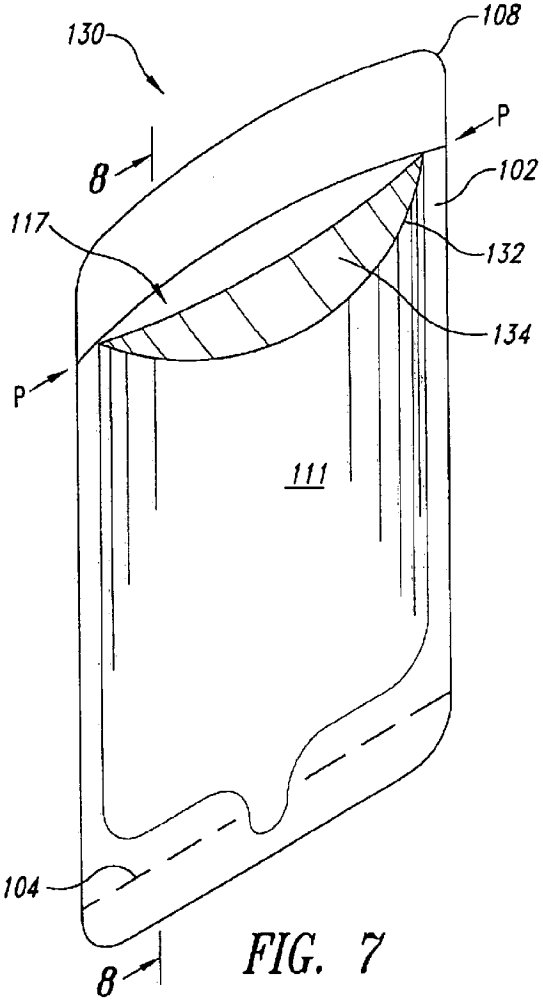
FIG. 7 shows an orthographic view of the single-use container according to the embodiment of FIG. 6.

FIGS. 6–8 illustrate an additional embodiment of the invention in which the front panel 111 of the single use container 130 is provided with a score or crease 132 describing an arc that begins at or near a first end 105*a* of the edge 105 of the front panel 111, then descends downward onto the front panel 111, and terminates at a second end 105*b* of the edge 105 of the front panel 111. The arcuate score 132 defines, between the score 132 and the edge 105, a self-stiffening flap 134.

The flap 134 is configured so that when compressing pressure is applied at points p, as indicated in FIG. 7, while slight downward pressure is applied to the edge 105 of the front panel 111, the opening 117 of the pouch 112 widens, and the self-stiffening flap 134 angles inward. As the compressing pressure increases, the inward angle of the flap 134 also increases, becoming more rigid because of the arcuate shape of the score 132.

FIG. 8 is a cross-sectional view taken along lines 8—8 of FIG. 7 showing the container 130 in the position previously described, with the flap 134 angled inward at the score line 132. As may be seen, the flap 134 and the lower portion of the front panel 111 define a substantial angle therebetween.

In use, the self-stiffening flap 134 is advantageous, inasmuch as it provides a rigid or semi-rigid edge upon which a tool, such as a knife, spoon, or spatula may be scraped. Thus, the user may insert a spatula loaded with mayonnaise into the opening 117, then draw the spatula against the edge 105 of the flap 134 to scrape the mayonnaise off the spatula for deposit within the pouch 112. When the pressure is released from the points p on the container, the flap 134 returns to its normal configuration, whereupon the closure flap 108 may be sealed against the upper portion of the panel 111, as previously described.

Figure 10:
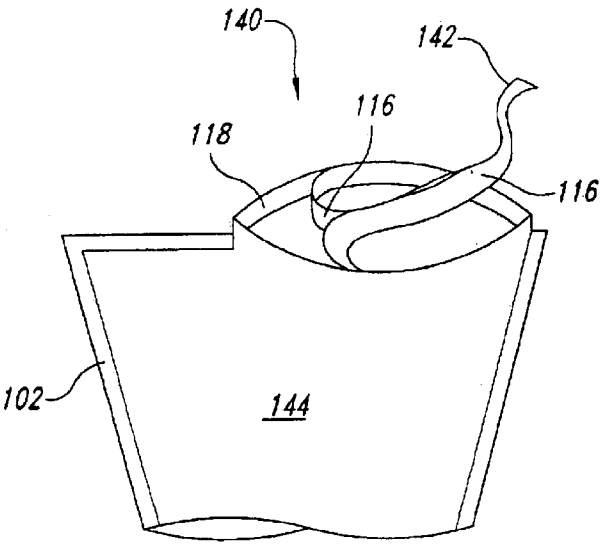
FIG. 10 shows a detail of the embodiment of FIG. 9.
Figure 9:
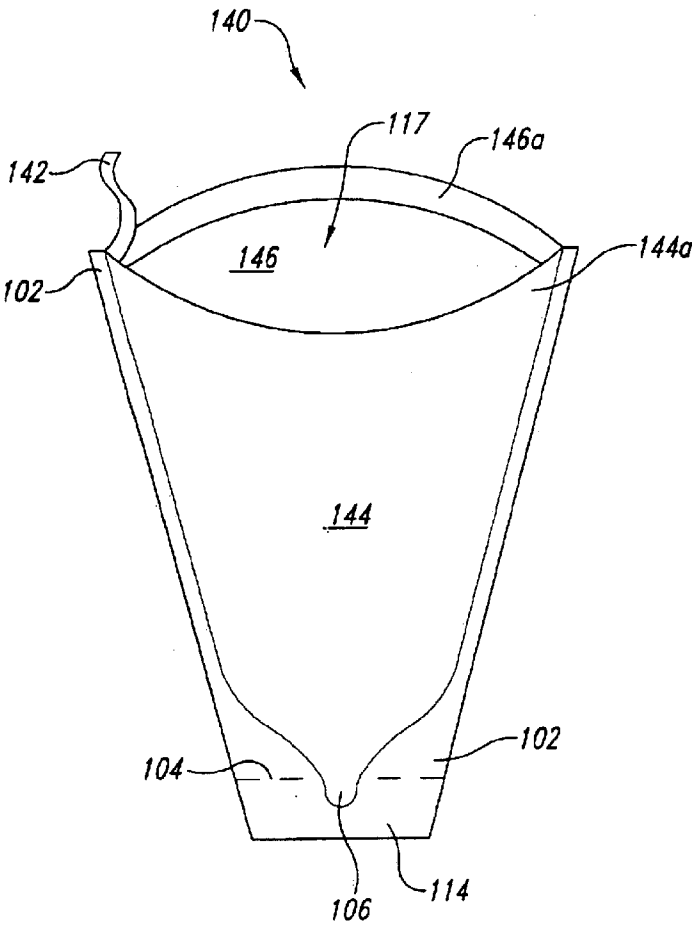
FIG. 9 illustrates a single-use container according to a fourth embodiment of the invention.

FIGS. 9 and 10 illustrate an additional embodiment of the invention, in which the single use container 140 is formed in the shape of a cone or funnel. According to this embodiment of the invention, the container 140 does not rely upon a fold-over flap for closure, as in previous embodiments. Instead, the top edges 144*a*, 146*a* of the front and back panels 144, 146 of the container 140 are each provided with pressure-sensitive adhesive strips 118 covered by release liner strips 116. A tab or streamer 142 is affixed at one end to each of the release liner strips 116, such that, when the tab 142 is pulled away from the container 140, both of the release liner strips 116 will be peeled from their respective adhesive surfaces, thereby exposing the pressure-sensitive adhesive 118 on the edges 144*a*, 146*a* of the front and back panels 144, 146. After the release liners 116 are removed from the pressure-sensitive adhesive 118, the edges 144*a*, 146*a* may be pressed together to seal the container 140.

An advantage of the embodiment of FIGS. 9 and 10 is that, because the release liners 116 are present on both surfaces to be joined, contaminants will not interfere with closure of the container 140. Whatever materials are inadvertently deposited on the edges 144*a*, 146*a* of the container as it is being filled will be removed when the liners 116 are removed from the adhesive 118, exposing clean surfaces for an effective seal.

Figure 11:
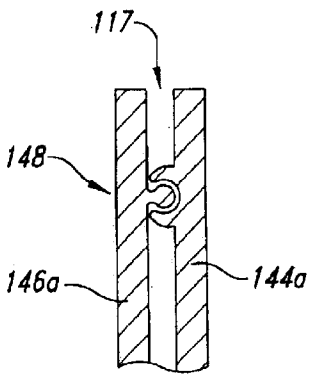
FIG. 11 illustrates a detail of a fifth embodiment of the invention.

According to an alternative embodiment of the invention, the edges 144*a*, 146*a* are provided with a pressure-sensitive interlocking-closure 148, of a type commonly known and used in the industry for reopenable closures on plastic bags, and illustrated in cross-section in FIG. 11. Such a closure permits opening and resealing of the pouch opening 117 while providing a secure closure.

While various embodiments of the invention have been described and illustrated as being formed using front and back panels, it will be recognized that the single-use container may be formed using tubular material, such that the sealed region 102 is not required to define the sides of the storage pouch 112 but only an end portion of the container. Alternatively, the container may be formed by folding material and sealing along one edge only, or by folding from two sides, with a seam formed on a front or back panel of the container. Thus, the use of the terms "front" and "back" panels in the specification or in the claims is not intended to suggest that the panels must be formed separately.

It will also be recognized that features of the various embodiments of the invention may be combined according to the needs of a particular use, and thus, such combinations fall within the scope of the invention.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

What is claimed is:

1. A single-use container, comprising:

front and back panels positioned in face-to-face relationship with edges of the panels joined together to define a pouch;

a first opening of the pouch defined by a portion of the edges of the front and back panels not joined together;

a pressure-sensitive strip affixed to at least the back panel adjacent to the first opening of the pouch and configured to seal the opening when the opening is pressed closed;

a stiffener flap defined by an arcuate score line in the front panel adjacent to the first opening of the pouch, the stiffener flap configured to bend sharply inward at the score line to form a stiffened projection when the container is pressed inward at extreme ends of the first opening; and a tear line formed in the container along which the container is configured to be torn, the tear line positioned such that tearing along the tear line will create a second opening in the pouch.

2. The single-use container of claim 1 wherein the edges of the front and back panels are joined by a sealed region, and wherein the tear line comprises at least one perforation formed in the sealed region.

3. The single-use container of claim 1, further comprising a spout defined by a portion of a sealed region where the region narrows along a short length thereof, the spout positioned relative to the tear line to open when the container is torn along the tear line.

4. The single-use container of claim 1 wherein the container is substantially funnel shaped, with the first opening of the pouch corresponding to a large opening of the funnel shape, and the tear line located at a position corresponding to a small opening of the funnel shape.

5. The single-use container of claim 1 wherein the front and back panels are formed from a material impervious to fluids.

6. A single-use container, comprising:

front and back panels positioned in face-to-face relationship with edges of the panels joined together to define a pouch;

a first opening of the pouch defined by a portion of the edges of the front and back panels not joined together;

a pressure-sensitive strip affixed to at least the back panel adjacent to the first opening of the pouch and configured to seal the opening when the opening is pressed closed;

a tear line formed in the container along which the container is configured to be torn, the tear line positioned such that tearing along the tear line will create a second opening in the pouch;

a tool pouch defined on four sides by a sealed region of the front and back panels; and a spreading tool positioned within the tool pouch.

7. The single-use container of claim 6 wherein the pressure sensitive strip comprises a reopenable interlocking seal.

8. The single-use container of claim 6 wherein the back panel comprises a flap coupled to the back panel and extending beyond an edge of the front panel, the flap configured to fold over the front panel and close the first opening.

9. The single-use container of claim 8 wherein the pressure sensitive strip is positioned on the flap.

10. The single-use container of claim 9, further comprising a removable release liner applied over the pressure sensitive strip to protect the pressure sensitive strip.

11. The single-use container of claim 6 wherein the pressure sensitive strip comprises first and second pressure sensitive adhesive strips positioned adjacent to the unjoined portions of the edges of the front and back panels, respectively, and configured to meet when the first opening is pressed closed, the first and second pressure sensitive adhesive strips each including a release liner.

12. The single-use container of claim 11, further comprising a pull tab formed onto first ends of the release liners of the first and second pressure sensitive adhesive strips and configured to be grasped by a user to peel the release liners from the first and second pressure sensitive adhesive strips when the pull tab is drawn away from the container.

13. The single-use container of claim 6 wherein the tool pouch is intersected by the tear line to release the tool from the pouch when torn.

14. The single-use container of claim 6 wherein the container is substantially rectangular.

15. The single-use container of claim 6, further comprising a stiffener flap defined by an arcuate score line in the front panel adjacent the first opening of the pouch, the stiffener flap configured to bend sharply inward at the score line to form a stiffened projection when the container is pressed inward at extreme ends of the first opening.

* * * * *